US007874947B1

(12) United States Patent
Wolfinbarger et al.

(10) Patent No.: US 7,874,947 B1
(45) Date of Patent: Jan. 25, 2011

(54) LAWN DART

(75) Inventors: Ryan Wolfinbarger, Avon, IN (US); Craig Malmloff, Fishers, IN (US); Chan Chee Kau, Kowloon (HK)

(73) Assignee: Fundex Games Ltd., Indianapolis, IN (US)

( * ) Notice: Subject to any disclaimer, the term of this patent is extended or adjusted under 35 U.S.C. 154(b) by 523 days.

(21) Appl. No.: 11/962,418

(22) Filed: Dec. 21, 2007

(51) Int. Cl.
*A63B 65/02* (2006.01)

(52) U.S. Cl. ..... 473/578; 473/582

(58) Field of Classification Search ..... 473/578, 473/582, 585, 586
See application file for complete search history.

(56) References Cited

U.S. PATENT DOCUMENTS

| | | | | |
|---|---|---|---|---|
| 3,596,910 | A | 8/1971 | Rizzo | |
| 4,019,738 | A | 4/1977 | Tong | |
| 4,833,995 | A | 5/1989 | Gotz et al. | |
| 4,946,172 | A | 8/1990 | Wong | |
| 5,067,728 | A | 11/1991 | Dadbeh | |
| 5,112,062 | A | 5/1992 | Pratt | |
| 5,207,434 | A | 5/1993 | Oudekerk | |
| 5,553,413 | A | 9/1996 | Gannon | |
| 5,642,887 | A | 7/1997 | Orav | |
| 5,846,147 | A | 12/1998 | Basik | |
| 5,951,419 | A | 9/1999 | Cameneti | |
| 6,010,419 | A * | 1/2000 | Rappaport et al. | 473/613 |
| 6,042,494 | A | 3/2000 | Rappaport et al. | |
| 6,068,260 | A | 5/2000 | Dean | |
| 6,200,237 | B1 | 3/2001 | Barrie | |
| 7,331,886 | B2 * | 2/2008 | Morris et al. | 473/578 |
| 2003/0045381 | A1 | 3/2003 | Morris et al. | |

FOREIGN PATENT DOCUMENTS

| | | |
|---|---|---|
| JP | 02-277475 | 11/1990 |

* cited by examiner

*Primary Examiner*—John Ricci
(74) *Attorney, Agent, or Firm*—Adam K. Sacharoff; Much Shelist

(57) ABSTRACT

In one embodiment there is provided a lawn dart having a shaft that connects to a head assembly at one end thereof. A sleeve is mounted coaxially about the shaft. The sleeve has an inner profile that matches a predetermined cross-section of the sleeve such that the sleeve is capable of axially movement and not capable of rotationally movement relative to the shaft. A plurality of fins is mounted on the sleeve.

14 Claims, 3 Drawing Sheets

LAWN DART

FIELD OF THE INVENTION

The invention relates to lawn dart games.

BACKGROUND OF THE INVENTION

As initially configured, lawn darts, consisted of large, metal-tipped darts. The darts were thrown with an underhand motion toward a target ring placed flat upon the ground. The objective being to cause the dart to stick into the ground within the ring. These types of lawn darts were received favorably by the public, in part because the dart typically remained where it landed, thus rewarding an accurate and skillful throw. However, these products were subsequently removed from the market because it was realized that the weight and metal tip of the lawn darts made them a hazard to safety.

More recently, others have proposed lawn games employing darts with blunt tips or similar design features intended to protect participants and others in the vicinity. For example, Wong U.S. Pat. No. 4,946,172 describes a lawn dart with the safety feature of a blunt, deformable nose section. Miranda U.S. Pat. No. 4,813,686 describes a shuttlecock with a weighted base and a soft, resilient cushion intended to prevent injury to players. Pratt U.S. Pat. No. 5,112,062 also describes a lawn dart with a safety blunt nose section and a rotating and sliding shaft section.

Unfortunately, safety lawn darts have been less favorably received. As a result, there is a continual need to improve upon the prior art safety lawn darts.

SUMMARY OF THE INVENTION

In one embodiment there is provided a lawn dart having a shaft that connects to a head assembly at one end thereof. A sleeve is mounted coaxially about the shaft. The sleeve has an inner profile that matches a predetermined cross-section of the sleeve such that the sleeve is capable of axially movement and not capable of rotationally movement relative to the shaft. A plurality of fins is mounted on the sleeve.

The lawn dart in this embodiment may have a head assembly that includes a plurality of grooves separately positioned about the head assembly such that each groove is aligned with a fin. In addition, the head assembly may include a top element and a bottom element. The top element may include a central opening to receive the first end region of the shaft and include an outer profile that expands from the first end region of the shaft to the bottom element. The outer profile of the bottom element may also be defined to expand outwardly from the first end to an apex region and then slopes inwardly and downwardly to a blunt tip.

The shaft may also include a stopping member positioned near the second end region to stop the sleeve from axial movement. The shaft of the lawn dart may have a predetermined cross-section shaped as an X.

Yet further, each groove may include a first end positioned towards the blunt tip and include a second end positioned towards the top element such that the groove extends over the apex region.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF EMBODIMENTS OF THE INVENTION

Figure 1:
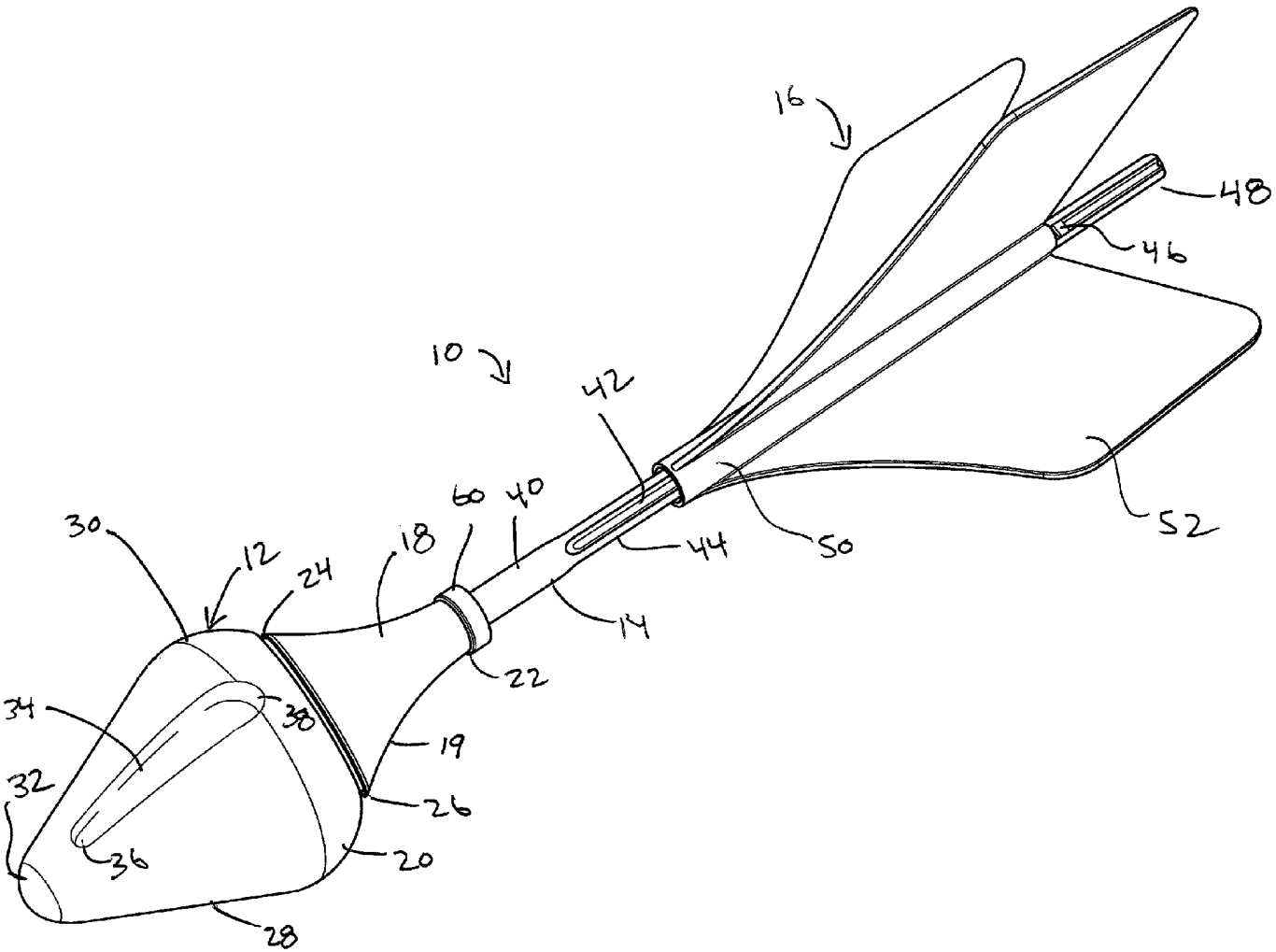
FIG. 1 is a perspective view of a lawn dart in accordance to an embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
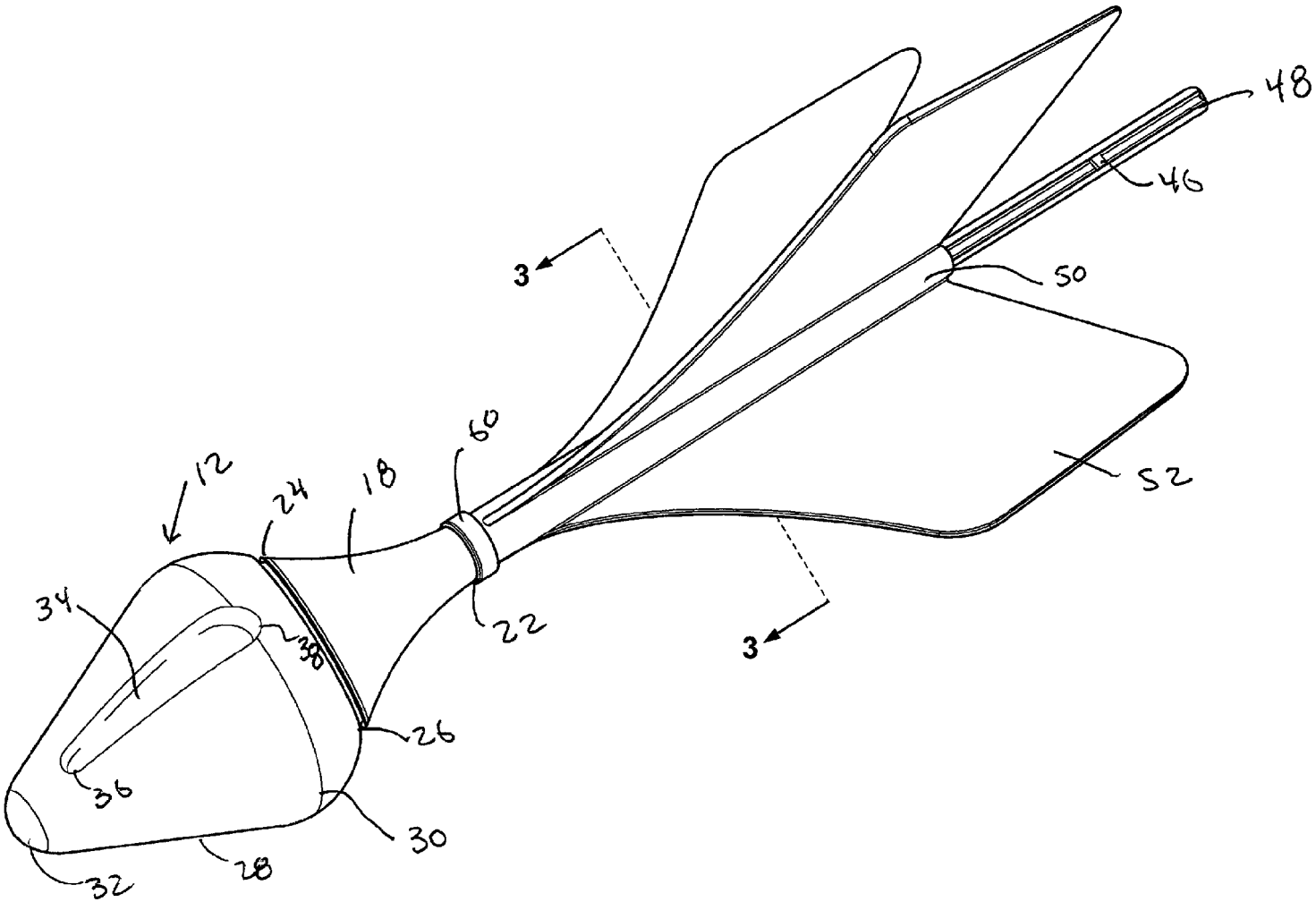
FIG. 2 is a perspective view of a lawn dart in accordance to an embodiment of the present invention.
Figure 3:
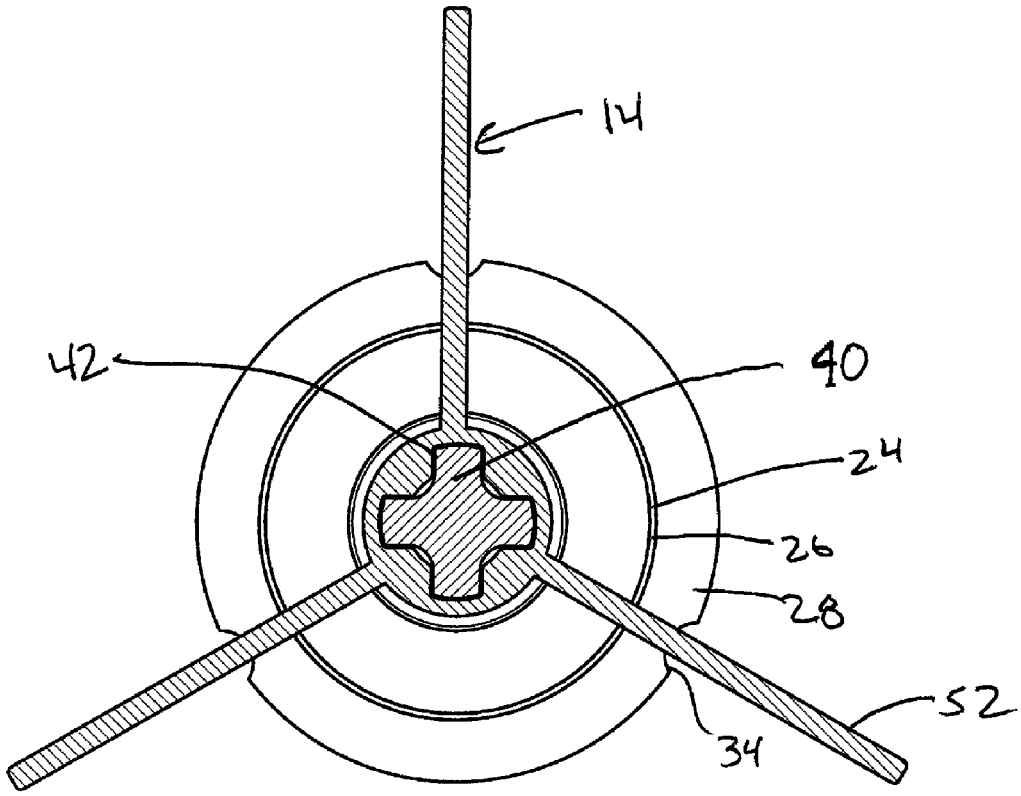
FIG. 3 is a cross-section view through line 3-3 taken in FIG. 2.

Referring to FIGS. 1 through 3, a safety lawn dart 10 of one embodiment of the invention has a weighted head assembly 12 mounted at the end of an elongated shaft 14 about which is mounted a fin assembly 16.

The head assembly 12 consists of a top element 18 and a bottom element 20. The top element 18 includes a central opening through which the end of the shaft 14 would be in fixed engagement. The top element 18 includes an outer profile 19 that from an end 22 at its connection with the shaft expands in dimension to an opposing end 24 that connects to the bottom element 20. The expanding profile is more sloped than a constant taper such that the profile expands outwardly at a greater degree as it approaches end 24.

The bottom element 20 is formed of a suitable material to provide for a semi-rigid structure such as cast polyvinyl chloride or hard rubber. The bottom element 20 includes a first end 26 formed to connect to the end 24 of the top element 18. The outer profile 28 of the bottom element expands outwardly from the first end 26 to an apex region 30 and then slopes inwardly and downwardly to a blunt tip 32. In addition, the bottom element 20 may include at least one groove 34. The groove 34 is positioned laterally such that one groove end 36 is positioned towards the blunt tip 32 and a second groove end 38 is positioned towards the first end 26, such that the groove travels over the apex region 30.

The shaft 14 includes a body 40 with a portion 44 thereof that includes an outer perimeter with a cross-sectional shape 42 defined in the letter X or as two cross beams. The portion 44 of the shaft 14 does not need to extend through the entire length of the shaft 14 as will be further discussed below. The shaft 14 also includes a stopping member 46 position need an end 48 distal to the head assembly 12.

The fin assembly 16 is disposed about the body 40 of the shaft 14, and includes a sleeve 50 that rides over the body 40 only in an axial direction. To limit the movement of the fin assembly 16 to only an axial movement, the sleeve 50 includes a region with an inner perimeter 52 that includes a cross-sectional shape 54 that matches the cross-sectional shape 42 defined on the portion 44 of the body 40, or in the letter X. It is well within the scope of the present invention to provide shaft and sleeve with other cross-sectional shapes that match and provide for the same type of limiting movement. Therefore, the sleeve 50 is strictly prohibited from rotating about the shaft 14. It has been determined that if the sleeve 50 was rotating the draft tends to slow down in the faster because a spinning fin assembly 16 cuts into the air adding more air drag to the dart.

The fin assembly 16 includes at least one curved fin 52 extending from the sleeve 50. It is preferable to include a plurality of curved fins 52 and most preferable to have three curved fins 52 extending at an equal distance from each other around the sleeve.

The curved fins 52 may also be positioned such that each fin is aligned with a groove 34 in the bottom element 20. Therefore, a groove 34 would be provided for each curved fin 52.

A lawn target game employing a lawn dart 10 of an embodiment of the invention may be played by placing a target ring or the like flat upon a lawn surface. One or more players may then take turns tossing the darts from a predetermined distance toward the target, the objective being to cause the darts to land and remain within the target area. The construction of the lawn dart 10 facilitates this objective as will now be described with particular reference to FIGS. 1 through 3.

A player grasps the shaft 14 of the dart 10 towards the head assembly 12. The safety lawn dart is thrown in an under or over hand manner. The safety lawn dart 10 of the invention may be thrown with improved accuracy as result of the increased mass at the head assembly 12. During flight, passage of air axially moves along the grooves and over the curved surfaces of the fins 52, thereby causing the sleeve 50 to axially move towards the end of the shaft 14 for improved balance and accuracy during flight. The sleeve 50 slides toward the rear end of the shaft, into engagement with the stopping member 46.

As the lawn dart 10 of the invention approaches the ground surface in the region of the target, the arrangement of the head assembly 12 and fins 16 relative to the shaft 14 typically cause the head assembly to make initial contact. When the head assembly strikes the target surface, the sleeve 50 slides forward towards the head assembly and makes contact with a softer ring 60 positioned about the end 22 between the head assembly 12 and the shaft 14.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A lawn dart for use in lawn games comprising:

an elongated shaft defining an axis, said shaft having a first end region and an opposite second end region and having an intermediate region between the first and second end regions with a predetermined cross-section;

a head assembly mounted at said first end region of said shaft;

a sleeve mounted coaxially about said shaft, the sleeve having an inner profile matching the predetermined cross-section of the intermediate region such that said sleeve is capable of axially movement and not capable of rotationally movement relative to said shaft; and a plurality of fins mounted on said sleeve, and wherein the head assembly includes a plurality of grooves separately positioned about the head assembly such that each groove is aligned with a fin.

2. The lawn dart of claim 1, wherein the shaft includes a stopping member positioned near the second end region.

3. The lawn dart of claim 1, wherein the predetermined cross-section has an X shape.

4. A lawn dart for use in lawn games comprising:

an elongated shaft defining an axis, said shaft having a first end region and an opposite second end region and having an intermediate region between the first and second end regions with a predetermined cross-section;

a head assembly mounted at said first end region of said shaft;

a sleeve mounted coaxially about said shaft, the sleeve having an inner profile matching the predetermined cross-section of the intermediate region such that said sleeve is capable of axially movement and not capable of rotationally movement relative to said shaft; and a plurality of fins mounted on said sleeve, wherein the head assembly includes a top element and a bottom element, the top element includes a central opening to receive the first end region of the shaft, and includes an outer profile that expands from the first end region of the shaft to the bottom element, the outer profile of the bottom element is defined to expand outwardly from the first end to an apex region and then slopes inwardly and downwardly to a blunt tip.

5. The lawn dart of claim 4, wherein the head assembly includes a plurality of grooves separately positioned about the head assembly such that each groove is aligned with a fin.

6. The lawn dart of claim 5, wherein each grooves includes a first end positioned towards the blunt tip and includes a second end positioned towards the top element such that the groove extends over the apex region.

7. The lawn dart of claim 6 further comprising a ring positioned about the central opening of the top element.

8. A lawn dart for use in lawn games comprising:

an elongated shaft defining an axis, said shaft having a first end region and an opposite second end region and having an intermediate region between the first and second end regions with a predetermined cross-section;

a head assembly mounted at said first end region of said shaft, and wherein the head assembly includes a top element and a bottom element, the top element includes a central opening to receive the first end region of the shaft, and includes an outer profile that expands from the first end region of the shaft to the bottom element, the outer profile of the bottom element is defined to expand outwardly from the first end to an apex region and then slopes inwardly and downwardly to a blunt tip;

a sleeve mounted coaxially about said shaft, the sleeve having an inner profile matching the predetermined cross-section of the intermediate region such that said sleeve is capable of axially movement and not capable of rotationally movement relative to said shaft;

a plurality of fins mounted on said sleeve; and a plurality of grooves separately positioned about the head assembly such that each groove is aligned with a fin.

9. The lawn dart of claim 8, wherein each grooves includes a first end positioned towards the blunt tip and includes a second end positioned towards the top element such that the groove extends over the apex region.

10. The lawn dart of claim 9, wherein the shaft includes a stopping member positioned near the second end region.

11. The lawn dart of claim 10 further comprising a ring positioned about the central opening of the top element.

12. The lawn dart of claim 8, wherein the predetermined cross-section has an X shape.

13. A lawn dart for use in lawn games comprising:

an elongated shaft defining an axis, said shaft having a first end region and an opposite second end region and having an intermediate region between the first and second end regions;

a head assembly mounted at said first end region of said shaft and wherein the head assembly includes a top element and a bottom element, the top element being mounted to the first end region of the shaft, and includes an outer profile that expands from the first end region of the shaft to the bottom element, the outer profile of the bottom element is defined to expand outwardly from the first end to an apex region and then slopes inwardly and downwardly to a blunt tip;

a sleeve mounted coaxially about said shaft; and a plurality of fins mounted on said sleeve.

14. The lawn dart of claim 13, wherein:

the intermediate region between the first and second end regions defined on the elongated shaft includes a predetermined cross-section, and the sleeve has an inner profile matching the predetermined cross-section of the intermediate region such that said sleeve is capable of axially movement and not capable of rotationally movement relative to said shaft.

* * * * *